United States Patent [19]

DeChant et al.

[11] Patent Number: 4,909,328

[45] Date of Patent: Mar. 20, 1990

[54] FIRE EXTINGUISHER COMPOSITION AND APPARATUS

[75] Inventors: Keric DeChant, Brookfield; Desty Lorino, Milwaukee, both of Wis.

[73] Assignee: Lorino/DeChant Enterprises, Inc., Milwaukee, Wis.

[21] Appl. No.: 139,262

[22] Filed: Dec. 29, 1987

[51] Int. Cl.[4] ..... A62C 11/00

[52] U.S. Cl. ..... 169/30; 169/35; 239/327

[58] Field of Search ..... 169/30, 35, 71–77, 169/89, 43, 44, 46, 47, 66; 222/142.7, 206, 212, 215, 565; 239/327, 328, 558; 252/7

[56] References Cited

U.S. PATENT DOCUMENTS

| | | | |
|---|---|---|---|
| 1,483,043 | 2/1924 | Fahnestock | 169/35 |
| 1,792,826 | 2/1931 | Dugas | 252/7 |
| 1,863,158 | 6/1932 | Greene | 222/565 |
| 2,207,834 | 7/1940 | Stern | 222/215 X |
| 2,480,606 | 8/1949 | Rabbitt | 222/565 X |
| 2,731,093 | 1/1956 | Gordon | 169/35 |
| 2,816,864 | 12/1957 | Warnock | 252/7 |
| 3,017,348 | 1/1962 | Steppe et al. | 252/7 X |
| 3,063,940 | 11/1962 | Cawood | 252/7 |
| 3,286,934 | 11/1966 | Schneller | 239/327 |
| 3,325,066 | 6/1967 | Allen | 222/565 X |
| 3,411,674 | 11/1968 | Gould | 222/215 |
| 4,044,836 | 8/1977 | Martin et al. | 169/30 |
| 4,234,432 | 11/1980 | Tarpley, Jr. | 252/7 X |
| 4,307,823 | 12/1981 | Heiss et al. | 239/327 X |
| 4,691,822 | 9/1987 | Malancon, Jr. | 222/465.1 X |
| 4,723,691 | 2/1988 | Minkevitch et al. | 169/30 X |

FOREIGN PATENT DOCUMENTS

| | | | |
|---|---|---|---|
| 1161146 | 1/1964 | Fed. Rep. of Germany | 252/7 |

OTHER PUBLICATIONS

Kirk Othmer Encyclopedia of Chemical Technology, (3rd ed., 1984), pp. 443–465.

*Primary Examiner*—Sherman D. Basinger
*Assistant Examiner*—James M. Kannofsky
*Attorney, Agent, or Firm*—Dressler, Goldsmith, Shore, Sutker & Milnamow, Ltd.

[57] ABSTRACT

Composition and apparatus are disclosed for a dry-chemical fire extinguisher. The dry-chemical composition has a particle size less than 5 μm and may be in combination with a flow agent, a dessicant or other anti-caking agent. The fire extinguisher apparatus is a transparent polymer container with a delivery head containing multiple openings. Manual compression of the container forces the release of a fire-extinguishing cloud of the dry-chemical composition. Among the most preferred dry-chemical fire-extinguishing compositions is monoammonium phosphate.

31 Claims, 2 Drawing Sheets

FIRE EXTINGUISHER COMPOSITION AND APPARATUS

BACKGROUND OF THE INVENTION

1. Field of the Invention

This invention relates to a method and a means for extinguishing fires utilizing a non-pressurized device and a dry chemical.

2. Description of Related Art

Fire extinguishing agents may very well be one of the most significant safety devices commonly employed by modern man. As the Kirk Othmer Encyclopedia of Chemical Technology (3 ed., 1984) notes "[c]ontrol and extinguishment of fire has always been a human concern. Water was the first agent to be used; however, the need for agents other than water became apparent as the industries of civilization introduced new and more combustible fire materials. Plastics, chemicals, petroleum products, and combustible metals have become daily fire hazards that have to be dealt with by agents other than water."

The combustion process has four basic prerequisites heat; fuel; oxidizing agent; and suitable chemical-reaction path. Thus, inhibiting a combustion process must involve one or more of the following: remove heat at a faster rate than it is released; separate the fuel and the oxidizing agent; dilute the vapor phase concentration of fuel and oxidizing agent below that which is necessary for combustion; and terminate the chain-reaction sequence.

From a practical standpoint these inhibitory processes are carried out by a variety of commonly employed extinguishants. For example, water and carbon dioxide act by exerting a cooling effect. carbon dioxide additionally acts by diluting or inerting the available oxygen. Separation of fuel from the air (oxygen) is usually achieved by the foams, although since carbon dioxide and the halogenated hydrocarbon gasses (Halons) are heavier than air, they, too, can form a barrier between the fuel and air.

The ability of the Halons and dry chemicals to extinguish fires cannot be completely explained by the above concepts, however. It is felt that their action is owing more to disruption of the chain reaction. Although the mechanism of reaction is not completely understood, there have been a number of possibilities proposed.

Nonetheless, dry-chemical extinguishants similar to the present invention, have been known and used for some time. Sodium bicarbonate, perhaps the original dry-chemical fire extinguishant, found widespread use as early as the Civil War. Today, the most commonly used chemical bases for dry-chemical extinguishants are sodium bicarbonate, potassium bicarbonate, potassium carbonate, monoammonium phosphate, and potassium chloride.

Early use of pressurized fire extinguishers containing a dry-chemical extinguishant appeared around 1913. These extinguishers suffered, however, from picking up moisture and ensuing caking problems. Subsequent formulations have improved the free-flowing nature of the extinguishant by coating it with magnesium stearate and more recently, the use of silicones. Silicones have not only proved helpful as a moisture-proof barrier but also improved the flow characteristics of the agent and imparted a higher degree of heat resistance to the extinguishant.

Most dry chemicals are ground to a particle distribution between 5–108 μm, most have a median particle size of about 20–30 μm. All existing agents contain additives that make them water repellant, less hygroscopic, and more flowable with a reduced tendency toward packing.

Despite such advances and modifications in the art of fire extinguisher design and extinguishant formulation, there remained to be developed a multipurpose, effectively fail-safe extinguisher. More specifically, the present invention has arisen due to the absence in the art of a non-pressurized version of a dry-chemical fire extinguisher which is capable of meeting basic safety and effectiveness requirements, such as would be indicated by an underwriter's approval, such as Applied Research Laboratories.

Monoammonium phosphate (MAP), while generally considered to be among the dry-chemical extinguishants, is also the base chemical used in something known as a multipurpose agent, and also known as all-use, all-purpose, and ABC agents.

The term "ABC agent" derives from the fact that fire extinguishing agents and equipment are classified by the National Fire Protection Association (NFPA) into four categories. The classes of fire relevant to the instant invention are as follows:

Class A fires are fires in ordinary combustible material, eg., wood, cloth, paper, rubber, and many plastics.

Class B fires are fires in flammable and combustible liquids, gases, and greases.

Class C fires are fires that involve energized electrical equipment where the electrical nonconductivity of the extinguishing media is of importance. (When electrical equipment is de-energized, extinguishers for Class A or B fires may be used safely.)

Most of the presently approved dry-chemical fire extinguishers are pressurized canisters which rely on an internal highly pressurized gas for expulsion of the extinguishant. The problem which arises, however, is that eventually the pressurized canister loses the necessary pressure and thus the extinguisher has a limited shelf-life and a need for maintenance. Without such maintenance these extinguishers present the dangers of malfunction and imbue the potential user with a false sense of security.

Additionally, because of the pressure that these canisters must necessarily withstand, the canisters are constructed of decidedly opaque materials. The opacity of such canisters prevents the user from even vaguely gauging the amount of extinguishant remaining at any given time, and especially either before or after use. Again, the possibilities of malfunction, nonfunction and a false sense of security present life-threatening dangers.

SUMMARY OF THE INVENTION

A dry-chemical composition suitable for extinguishing fires and having a particle diameter less than 5 μm is described together with a non-pressurized, fire-extinguishing apparatus suitable for delivery of the dry-chemical composition.

DESCRIPTION OF THE PREFERRED EMBODIMENTS

Figure 1A:
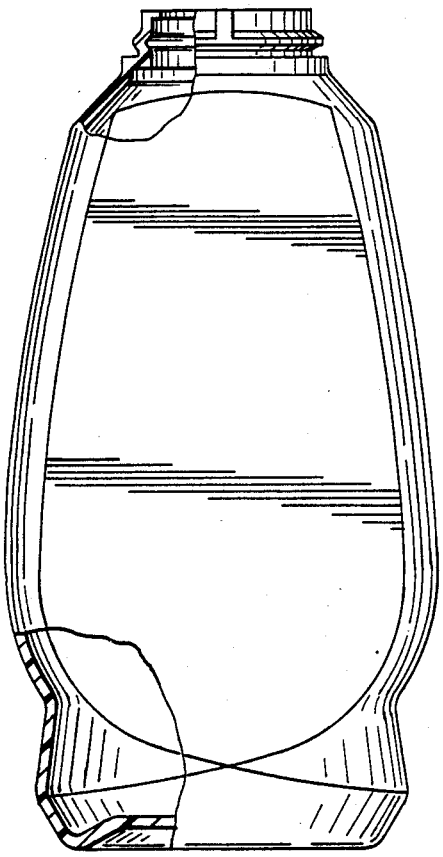
FIG. 1 illustrates a fire-extinguishing container suitable for hand compression.

The present invention describes a solid, dry powder, fire-extinguishant composition comprising a finely ground powder of high surface area having a particle diameter of less than 5 μm. This compositon may be used in combination with a flow agent, such as fumed silica, and optionally with a desiccant, such as tricalcium phosphate.

This dry powder extinguishant composition may be used in non-pressurized containers wherein manual compression of the container results in the release of a cloud of dry chemcial which extinguishes the fire. The use of a transparent container allows easy evaluation of the amount of dry chemical remaining in the fire extinguisher. Efficient release and dispersal of the dry chemical requires sufficient space within the container for the dry chemical and air to mix. The container neck size must be of a sufficient diameter to allow the dry chemical and air mixture to reach the dispersal head at a concentration and rate sufficient to provide a fire extinguishing quantity of dry chemical. The dispersal head containing multiple openings allows release of the dry chemical in a manner sufficient to extinguish flammable materials.

The composition of the present invention may be used in a non-pressurized container suitable for extinguishing fires in Class A, Class B or Class C fires. Dry-chemical compounds suitable for use in the present invention include monoammonium phosphate, ammonium sulfate, potassium sulfate, potassium chloride, sodium bicarbonate, potassium bicarbonate or any dry chemical suitable for extinguishing a fire. In a preferred embodiment of the invention, the fire extinguisher consists of a non-pressurized transparent container capable of manual compression releasing a directed cloud of extinguishant through a container head or nozzle. The transparent container allows easy visual determination of the amount of dry-chemical extinguishant available for use. The non-pressurized container eliminates the need for a propellant thereby assuring the function of the fire extinguisher by manual compression of the container.

Fire Extinguisher Parameters

A preferred embodiment of the fire extinguisher comprises a clear, transparent compressible container with a volume of 10 to 30 fluid ounces with a neck having a constriction greater than 17 mm. This constriction may be between 17 and 200 mm, more preferably between 30 and 100 mm and most preferably the diameter is 43 mm.

The fire extinguisher contains a delivery head with one or more orifices on its surface with a diameter of from 0.3 to 2.0 mm, most preferably from 1.0 to 1.5 mm. The delivery head is a moisture-resistant resealable port whereby moisture is essentially prevented from entering the extinguisher in the closed position. The fire extinguisher is activated by opening the delivery head containing the multiple orifices such that manual compression of the transparent polymer container produces a directed discharge of the dry-chemical extinguishant.

The delivery head of the fire extinguisher contains multiple orifices or openings which may number anywhere from 1 to 200. A more preferred embodiment numbers between 2 and 100 openings with an average diameter of about 0.3 to 2.0 mm. Even more preferred is a delivery head containing between 3 and 50 openings. Even more preferred is a delivery head containing between 4 and 25 openings and most preferred is a head containing between 5 and 12 openings with an average diameter of 1.0 to 1.5 mm. The working example illustrates a delivery head containing 9 openings with an average diameter of 1.0 to 1.5 mm.

The fire extinguisher and the fire-extinguishing compositions of the present invention contain the dry-chemical fire extinguishant in combination with a flow agent, such as silicon dioxide or fumed silica (CAB-O-SIL ®). The composition may contain between 0.5 and 15% of the flow agent with the balance being the dry-chemical fire extinguishant. More preferably the flow agent comprises 1 to 10% of the composition and most preferably 2 to 4% of the composition.

The fire extinguisher and the fire extinguishant composition of the present invention may also contain a desiccant, such as tricalcium phosphate or sodium/calcium borosilicate glass (HAGORB ® from Diamond Shamrock Chemical Company). The dry-chemical extinguishant may contain from 1 to 10% of the desiccant.

The fire extinguisher and the dry powder fire extinguishant composition comprises a finely ground powder of high surface area having a particle diameter of less than 5 μm. The particle diameter may be between 0.0001 and 5 μm, more preferably between 0.01 and 1 μm, even more preferably between 0.01 and 0.5 μm and most preferably 0.165 μm.

The fire extinguisher of the present invention has as one of its preferred embodiments an extinguisher container holding less than 16 ounces of extinguishant and flow agent suitable for distribution through the delivery head means when the container is compressed. A more preferred fire extinguisher contains anywhere between 8 and 16 ounces of extinguishant and flow agent. A most preferred fire extinguisher contains 10 ounces of extinguishant and flow agent. In a preferred embodiment, the fire extinguisher container has an internal volume of 10 to 20 fluid ounces and contains a settled volume of dry-chemical extinguishant occupying 50 to 85% of that volume. An even more preferred embodiment of the fire extinguisher of the present invention has a container with an internal volume of 14 fluid ounces and contains a settled volume of extinguishant occupying 65 to 75% of that volume.

The volume of the container is such that the compression of the bottle through the delivery head produces a flow of the dry-chemical extinguishant for a period greater 6 seconds, preferably between 6 and 60 seconds and most preferably 15 seconds.

The period of release is a function of the amount of pressure applied to the container, the volume of the container and the number and diameter of the holes in the delivery head. A container with an internal volume of 14 fluid ounces containing 10 ounces of dry chemical and a delivery head containing 9 holes with an average diameter of between 1.0 and 1.5 mm when manually compressed will deliver a fire-extinguishing amount of the dry chemical. The duration of the flow with this extinguisher is a function of the amount of manual pressure applied to the container. Delivery of the dry composition is facilitated by shaking the container prior to compression to aid in the uniform dispersion of the dry chemical through the delivery head.

Figure 1B:
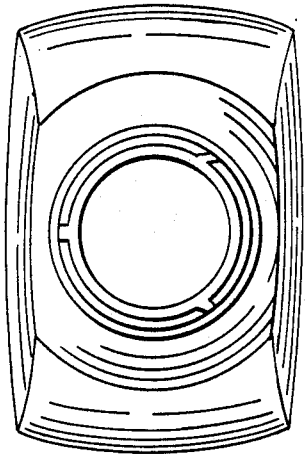
Figure 1D:
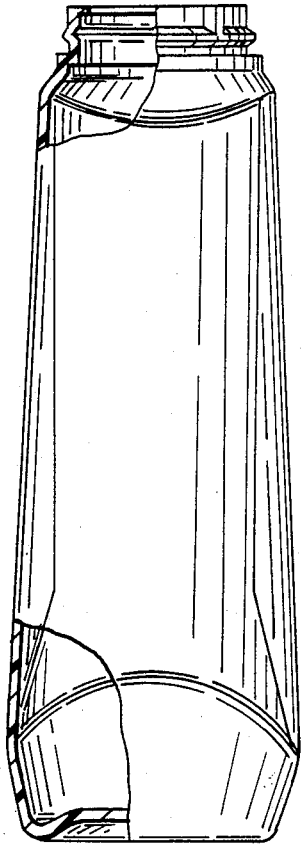
Figure 1C:
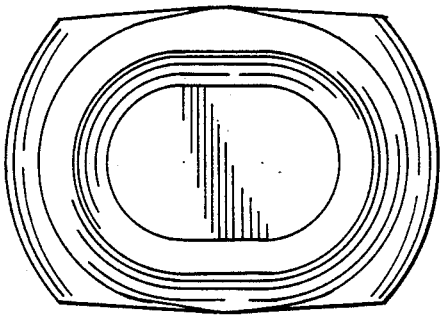
Figure 2A:
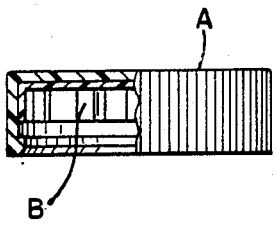
FIG. 2 illustrates the delivery head suitable for attaching to the fire extinguisher container.
Figure 2B:
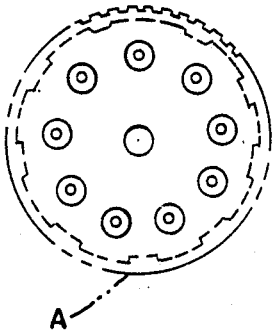
Figure 2C:
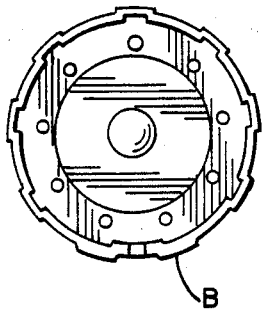
Figure 2D:
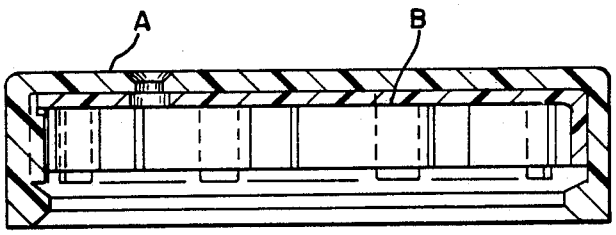

The present invention in one of its simplest, most elegant embodiments consists simply of a plastic squeeze bottle containing, predominantly, monoammonium phosphate with minor quantities (sum total less than about 10%) of a dessicant, a flow enhancer, and optionally a non-caking agent. The bottle is constructed with a wide neck for accepting a screw cap for expulsion of the extinguishant and having 9 sealable holes to keep out moisture during storage of the extinguisher (see FIGS. 1 and 2).

Method of Filling of Fire Extinguisher

The dry-chemical extinguishant of the present invention, due to its small particle size, requires special handling to facilitate the filling of the non-pressurized containers which function as the body of the fire extinguisher. Therefore, it was an important aspect of the present invention that a method for filling these containers be developed. A preferred method of filling the containers comprises a funneling device or similar means suitable for facilitating the movement of the dry-chemical composition into the fire extinguisher containers of the present invention. This filling is accomplished by shaking the funneling device as the dry-chemical material moves through the funneling device and into the container through the neck of th extinguisher bottle. The rate of shaking and the amplitude of the shaking must be sufficient to maintain the flow of the material without allowing a cake or blockage to occur in the funneling device.

A further aspect of the method of filling the fire extinguishers of the present invention is the shaking of the fire extinguisher container itself at a rate and amplitude which is sufficient to allow the filling of the container to a maximum volume with the dry-chemical extinguishant in a dispersed state. Following the filling process, the dry-chemical material settles in the container to a volume of 50 to 85%, more preferably 65 to 75% of the total volume.

Testing Procedure

In order to determine the functional utility of the compounds and fire extinguisher means of the present invention, it was necessary to develop a test procedure suitable for evaluating the device and material. The assay method for the fire extinguisher and fire-extinguishing, dry-chemical compositions consists of a test apparatus. This test apparatus comprises a steel pan or other suitable material wherein a test fuel consisting of a layer of not less than 2 inches of flammable liquid, such as N-heptane or gasoline, are poured into the pan. The surface of the heptane or gasoline was between 5¾ inches and 6¼ inches below the top of the pan. This free board of approximately 6 inches above the flammable liquid could be established and maintained by adding water as necessary.

For those fire extinguishers to be rated 1-B, the inside area of the pan was approximately 2.5 square feet and required approximately 3.25 gallons of flammable liquid. The fire extinguishers and the compounds to be tested were conditioned for 24 hours immediately prior to the test at 40° F. Optionally, a second set of fire extinguishers were contidioned at 70° F. prior to the test.

The test itself consisted of opening the delivery head means of the fire extinguishers and then lighting the fuel in the pan and allowing it to burn for 60 seconds before administering the dry-chemical composition to the fire with the fire extinguisher apparatus. The method of attacking the fire was to aim the delivery head at the base of the fire and sweeping the delivery head discharge nozzle from side to side while moving in on the fire. In no case did the operator of the fire extinguisher extend any part of his body past the edge of the test pan while fighting the fire. The fire extinguisher was weighed before and after use to determine the amount of dry-chemical composition necessary to extinguish the fire.

EXAMPLE 1

A fire extinguisher container with an internal volume of 14 fluid ounces and of monoammonium phosphate with a particle size of 0.0165 μm and containing 2% CAB-O-SIL ® was used. The fire extinguisher bottle had an internal volume of 14 fluid ounces and 10 ounces of the dry-chemical composition occupied that volume. The delivery head on the bottle was attached to the bottle through a neck region with a constriction having a diameter of 43 mm. The delivery head had 9 holes with an average diameter of 1.0 to 1.5 mm. Rotation of the top part of the delivery head counterclockwise 4–10 mm causes the 9 holes to open for passage of the dry chemical. Compression of the fire extinguisher by hand resulted in the release of a directed cloud of the dry-chemical composition aimed at the base of the burning pan. Each application of the dry chemical to the burning pan resulted in a directed stream of the dry chemical lasting approximately 10 to 20 seconds. When the extinguisher was tested with a pan containing 2.5 square feet of flammable liquid, it took approximately 8–13 seconds to extinguish the fire and used approximately 8–10 ounces of the dry chemical.

EXAMPLE 2

The method used for filling the fire extinguisher containers of the present invention with the dry-chemical compositions of the present invention requires a special procedure. To fill a container with an internal volume of approximately 14 fluid ounces with approximately 10 ounces of the fire-extinguishing composition requires the use of a filling device which is shaken at a rate and amplitude such that the composition does not clog the delivery device transferring the composition through the neck of the extinguisher bottle. The amount of shaking or vibration may be adjusted depending upon the particle size of the fire-extinguishing composition, the diameter of the delivery device, such as a funnel, and the rate of flow of the composition. The container itself may be shaken to facilitate packing of the dispersed dry-chemical composition in the container itself. Initially, the dispersed composition essentially fills the entire volume of the extinguisher container. With time, the dispersed dry-chemical composition settles in the container and occupies approximately 50 to 85% of the internal volume.

It will be apparent to the skilled practitioner that the more simple embodiments will facilitate the production of fire extinguishers of broad application and which are far less costly than those currently available. This will greatly increase the accessibility of fire extinguishers to those who might not normally purchase such safety devices due to considerations of cost. Moreover, the ease of use of the present invention is equally clear and thus, far less intimidating to the uninitiated to use than the comparatively complex, and potentially dangerous pressurized extinguishers.

It is therefore an object of the present invention to present an effective dry-chemical fire extinguisher with a particle size less than 5 μm which requires virtually no maintenance.

It is also an object of the present invention to construct a fire extinguisher which requires no propellant, other than manually exerted pressure, to remove the extinguishant from its container in a fashion that facilitates extinguishment of a fire.

Another object of the invention is to construct a fire extinguisher with a multi-orificed distribution head to cause a fire-extinguishing release of dry chemical when the container is compressed.

It is a further object of the present invention to construct a fire extinguisher which upon unaided visual inspection of the container avails the quantity of extinguishant remaining in the fire extinguisher.

Yet another object of the invention is to provide a fire extinguisher which is very simple to use by those without technical training.

Although the foregoing invention has been described in great detail by way of illustration and example for the purposes of clarity of understanding, it is obvious that numerous changes and modifications may be practiced within the scope of the appended claims.

We claim:

1. A fire extinguisher which comprises a container with an internal volume of about 10 to 30 fluid ounces, said container having a flexible side-wall capable of manual compression, a delivery head attached to the container through a neck region with a construction having a diameter greater than 17 mm, said delivery head having at least 9 orifices with an average diameter of about 0.3 to 2.0 mm, and a dry-chemical fire extinguishant having a particle diameter less than 5 μm partially filling the interior of the container, the remainder of said container comprising air at atmospheric pressure such that shaking the container creates a dispersion of the fire extinguishant in the air within the container, and manual compression of the container side-wall pressurizes the contents of the container to enable the continuous discharge of the fire extinguishant from the container through said orifices for a period of at least about 6 seconds.

2. The fire extinguisher of claim 1 wherein said fire extinguishant comprises a chemical selected from the group consisting of sodium bicarbonate, potassium bicarbonate, potassium carbonate, monoammonium phosphate, ammonium sulfate, potassium sulfate or potassium chloride.

3. The fire extinguisher of claim 1 fire extinguishant further comprises a flow agent.

4. The fire extinguisher of claim 3 fire extinguishant which further comprises a desiccant.

5. The fire extinguisher of claim 3 wherein the fire extinguishant comprises at least 0.5 weight percent silicon dioxide as the flow agent.

6. The fire extinguisher of claim 5 wherein the fire extinguishant comprises between 0.5 and 15 weight percent silicon dioxide as the flow agent.

7. The fire extinguisher of claim 6 wherein the fire extinguishant comprises about 2 weight percent silicon dioxide as the flow agent.

8. The fire extinguisher of claim 3 wherein the flow agent is fumed silica or silicon dioxide.

9. The fire extinguisher of claim 8 wherein the fire extinguishant comprises between about 0.5 to 15 weight percent of the flow agent.

10. The fire extinguisher of claim 9 wherein the fire extinguishant comprises 1 to 10 weight percent of fumed silica.

11. The fire extinguisher of claim 4 wherein the desiccant is tricalcium phosphate or sodium/calcium borosilicate glass.

12. The fire extinguisher of claim 11 wherein the fire extinguishant comprises between about 1 to 10 weight percent of the desiccant.

13. The fire extinguisher of claim 1 wherein said delivery head contains between 9 and 50 orifices.

14. The fire extinguisher of claim 13 wherein said delivery head contains between 9 and 25 orifices.

15. The fire extinguisher of claim 14 wherein said orifices have an average diameter of 1.0 to 1.5 mm.

16. The fire extinguisher of claim 15 wherein said delivery head contains 9 orifices.

17. The fire extinguisher of claim 1 wherein said fire extinguishant has a particle diameter between 0.0001 and 5 μm.

18. The fire extinguisher of claim 17 wherein said fire extinguishant has a particle diameter between 0.001 and 1 μm.

19. The fire extinguisher of claim 18 wherein said fire extinguishant has a particle diameter between 0.01 and 0.5 μm.

20. The fire extinguisher of claim 19 wherein said fire extinguishant has a particle diameter of 0.0165 μm.

21. The fire extinguisher of claim 1 wherein said container constriction has a diameter between 17 and 200 mm.

22. The fire extinguisher of claim 21 wherein said container constriction has a diameter between 30 and 100 mm.

23. The fire extinguisher of claim 22 wherein said container constriction has a diameter of 43 mm.

24. The fire extinguisher of claim 1 wherein the container has an internal volume of no greater than 16 fluid ounces.

25. The fire extinguisher of claim 24 wherein the container contains 8 to 16 ounces of fire extinguishant.

26. The fire extinguisher of claim 25 wherein the container contains 10 ounces of fire extinguishant.

27. The fire extinguisher of claim 1 wherein the manual compression of the container pressurizes the container to enable the continuous discharge of the fire extinguishant for a period of about 6 to 60 seconds.

28. The fire extinguisher of claim 27 wherein the manual compression of the container pressurizes the container to enable the continuous discharge of the fire extinguishant for a period of about 10 to 30 seconds.

29. The fire extinguisher of claim 28 wherein the manual compression of the container pressurizes the container to enable the continuous discharge of the fire extinguishant for a said time period of about 15 seconds.

30. The fire extinguisher of claim 1 wherein the container has an internal volume of 10 to 20 fluid ounces and contains a settled volume of fire extinguishant occupying 50 to 85% of the volume of the container.

31. The fire extinguisher of claim 30 wherein the container has an internal volume of 14 fluid ounces and contains a settled volume of fire extinguishant occupying 65 to 75% of the volume of the container.

* * * * *